United States Patent [19]

Falch

[11] 4,212,184

[45] Jul. 15, 1980

[54] MANUFACTURE OF FOIL CONTAINERS

[76] Inventor: Hans Falch, 205 Clarendon Heights, Bruce Street, Hillbrow, Johannesburg, South Africa

[21] Appl. No.: 875,027

[22] Filed: Feb. 3, 1978

[30] Foreign Application Priority Data

Feb. 10, 1977 [ZA] South Africa ..... 77/0778

[51] Int. Cl.[2] ..... B21D 22/00

[52] U.S. Cl. ..... 72/340; 113/1 G; 113/120 G; 113/120 W

[58] Field of Search ..... 113/1 G, 116 QA, 120 R, 113/120 G, 120 W, 121 A; 72/348

[56] References Cited

U.S. PATENT DOCUMENTS

| | | | |
|---|---|---|---|
| 3,229,886 | 1/1966 | Grogel | 113/120 G |
| 3,496,896 | 2/1970 | Smith | 113/120 G |
| 3,580,041 | 5/1971 | Tilly | 113/120 G |

FOREIGN PATENT DOCUMENTS

| | | | |
|---|---|---|---|
| 275285 | 10/1969 | Austria | 113/121 A |
| 894683 | 9/1953 | Fed. Rep. of Germany | 113/120 R |
| 105735 | 12/1974 | German Democratic Rep. | 113/120 G |
| 611320 | 10/1948 | United Kingdom | |
| 629430 | 9/1949 | United Kingdom | |
| 640998 | 8/1950 | United Kingdom | 113/121 A |
| 1185539 | 3/1970 | United Kingdom | |

*Primary Examiner*—Leon Gilden

*Attorney, Agent, or Firm*—Millen & White

[57] ABSTRACT

The objects of the invention are the manufacture of drawn foil containers which have better appearance and strength and which can be made with these advantages from thinner foil and with greater depth. The essential apparatus employed to achieve these objects having a punch for drawing the container, is characterized by upper and lower peripheral guide structures located around the punch which present a plurality of intercalating radially aligned ridge formations for forming in accordance with the process alternate upwardly and downwardly directed light indentations in a flat foil blank before it is drawn and lightly guiding the indented blank to fold into double fold pleats which are thereafter drawn over a drawing edge to form the walls of the container. The container produced is characterized by double fold pleats in its walls.

18 Claims, 13 Drawing Figures

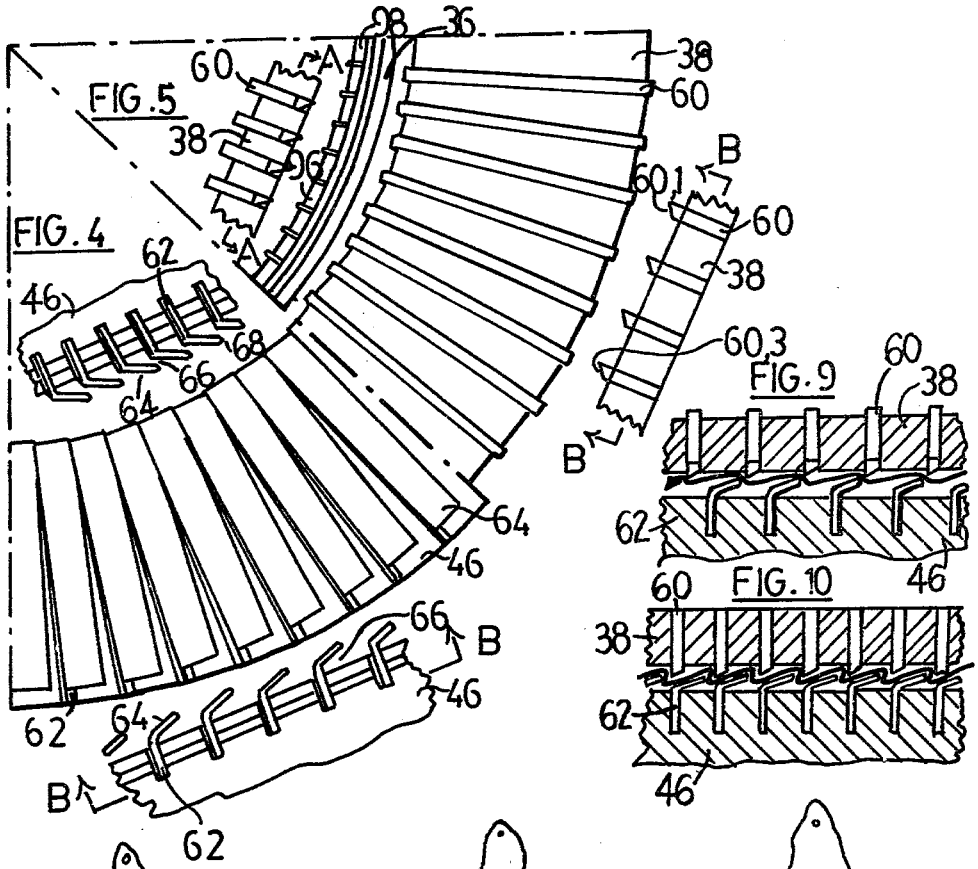
FIG. 5
FIG. 4
FIG. 9
FIG. 10
60
38
36
A
B
62
46
64
66
68
60.1
60.3
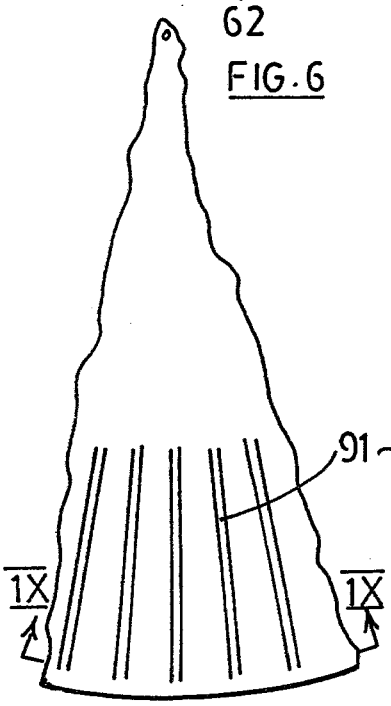
FIG. 6
91
1X
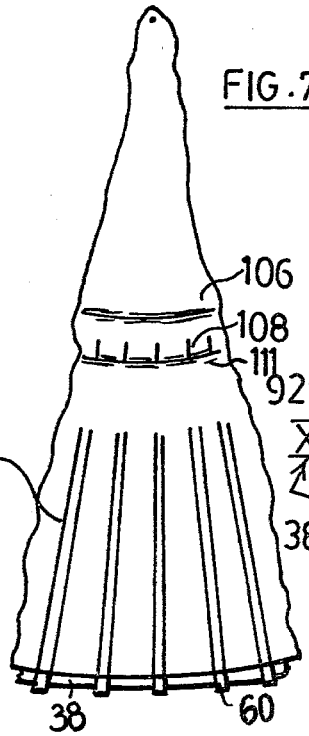
FIG. 7
106
108
111
91
38
60
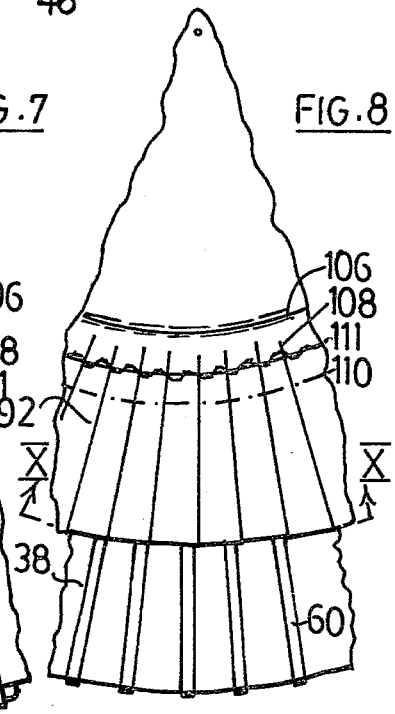
FIG. 8
106
108
111
110
92
X
38
60

MANUFACTURE OF FOIL CONTAINERS

BACKGROUND OF THE INVENTION

1. Field of the Invention

This invention relates to the manufacture of containers from foil. The invention relates in particular to a method of and apparatus for manufacturing containers from foil and to novel containers which have been manufactured with the apparatus and in accordance with the method.

2. Description of the Prior Art

In the manufacture of containers from foil the cost of material is the predominant cost factor, so that thin foil is used, which, while it is flat and smooth on the base of the container, becomes wrinkled on the walls. While the art of producing drawn metal sheels has been widely used and highly developed, the problem of eliminating wrinkles in the sides and flanges of the finished shell has never been satisfactorily solved in respect to many forms of shells and in respect to many kinds of and thicknesses of metal.

According to conventional drawing practice the sheet metal blank is put in position across a die cavity and is held in place against the die face by a yielding blank holder or pressure pad through which a punch is moved to engage the sheet and force the same into the die cavity, and as the punch enters the die, the border portion of the blank, that is held by yielding clamping pressure between the die face and the pressure pad, is drawn inwardly toward the drawing edge, as for example in the formation of a circular shell, or at the rounded corners of a rectangular shell, there must be a progressive reduction in the circumferential dimension of the diverging portions of the flange as they approach the drawing edge. In other words, each segmented portion of the border must become narrower as it approaches or is drawn inwardly toward the drawing edge, and this produces what may be termed circumferentially acting compressive forces in such border which tend to produce radially extending waves or wrinkles in the border portion of the blank. Although they have sometimes been described as pleats, the wrinkles formed in the conventional technique are in fact the result of random crumpling of the foil between die parts. The deeper the container to be formed, the more the wrinkles are formed and enlarge, and the greater are the problems arising from the wrinkles. The wrinkles cause stress in the foil which places limitations on the thinness of foil that can be used, the depth of container that can be formed and the appearance of the resulting product.

SUMMARY OF THE INVENTION

A method of manufacturing containers from flat foil in accordance with this invention comprises a sequence of steps including providing a flat foil blank, indenting the blank with alternate upwardly and downwardly directed indentations which extend in radial directions, drawing a shape which has a base and walls in the blank, during the drawing, lightly guiding the indented blank in a remaining flat area of the indented blank, so as to fold the flat area into regular double fold pleats, and flattening the double fold pleats before they move from the flat area of the blank into an area in which they form the walls.

The indentations will form a series of closely spaced, alternately upwardly and downwardly sloping faces in the surface of the blank, and the width of the faces may alternate between wider and narrower faces giving the blank a serrated saw-tooth appearance in a cross-sectional profile.

Preferably, in addition to the light guiding of the blank in the flat area during forming, the blank is scored in positions aligned with the indentations.

Where the container is broadly cup shaped, (more circular rather than rectangular), the indentations are located in an annular area of the blank which is destined to form the walls of the container. During the drawing of the cup shape the flat area of the blank will freely slide along the directions of the indentations.

The method may further include curling and folding the rim of the container to provide a strengthened rim and a ledge for receiving a lid.

Further according to the invention there is provided an apparatus for manufacturing foil containers, which comprises a punch for drawing a shape having a base and walls in a flat foil blank, an upper peripheral guide structure and a lower peripheral guide structure located around the punch, each peripheral guide presenting a plurality of generally radially aligned ridge formations, the ridge formations of the upper guide intercalating with the ridge formations of the lower guide for forming alternate upwardly and downwardly directed light indentations in the flat blank and during drawing, lightly guiding the indented blank into regular double fold pleats.

Preferably the apparatus further comprises a plurality of scoring formations located along a drawing edge in positions of radial correspondence with the ridge formations which form the indentations in the foil.

The punch, drawing edge and guides may be varied in accordance with the shape of the container to be formed. For a cup shaped container the punch and drawing edge will be circular and the guides annular. The lengths of the ridge formations may be approximately equal to the depth of the container to be formed. The ridge formations may comprise two sets of slats. One set may be held movably in slots in an upper slat holder and the other set may be held in a lower slat holder. Thus when a foil blank is positioned between the slats, the slats may be brought towards one another into light contact with the foil to thereby effect the indentations. The lower slats may be provided with wider bevelled faces for supporting the wider faces of the indented blank, with an undercut beneath the upper edge of the bevelled faces, the undercut edge being radially directed. The set of slats in the upper guide may be vertically directed downwards, each having a bevelled lower face. The slope of the bevelled lower face may be of the same or greater slope as the bevelled faces on the lower slats. The lower edge of the bevelled face of the upper slats may be positioned close to the lower slats such that when the sets of slats are moved towards each other the upper slats may intercalate the lower slats.

The apparatus may further include an ironing ring, positioned radially between the drawing edge and the slats for ironing the indentations before they move over the drawing edge.

The apparatus may conveniently also comprise foil blank cutting parts, die parts to form a ledge and/or a curl at the rim of the container and ejector means.

A foil container in accordance with this invention comprises a drawn shape including a base and walls, the walls being characterised by regions which are folded into regular double fold pleats, fold lines of the pleats extending longitudinally along the walls and with regular spacing between the pleats in regions where they occur.

Preferably the walls comprise score marks in an area of the walls adjacent the base which score marks extend longitudinally along the walls and are aligned with the pleats and then continue with the pleats over the remaining area of the walls.

The invention will now be more fully described by way of example with reference to the accompanying drawings in which:

BRIEF DESCRIPTION OF THE DRAWINGS

FIG. 4 is a plan view of an eighth segment of the lower slats and slat holder used in the apparatus shown in FIG. 1, with partial elevations on the slats and slat holder from inside, A—A, and from outside, B—B, FIG. 5 is an underneath view of an eighth segment of the upper slats and slat holder used in the apparatus shown in FIG. 1, with partial elevations on the slats and slat holder from inside, A—A, and from outside, B—B.

FIG. 6 is an underneath view of a segment of foil blank after having been indented and before drawing, FIG. 7 is an underneath view of a segment of foil blank after having been indented and drawn about one quarter of the draw, FIG. 8 is an underneath view of a segment of the foil blank after having been indented and drawn about three quarters of the draw, FIG. 9 is a cross sectional elevation on the foil segment shown in FIG. 6 on section IX—IX, FIG. 10 is a cross sectional elevation on the foil segment shown in FIG. 8 on section X—X.

DESCRIPTION OF THE PREFERRED EMBODIMENTS

Figure 1:
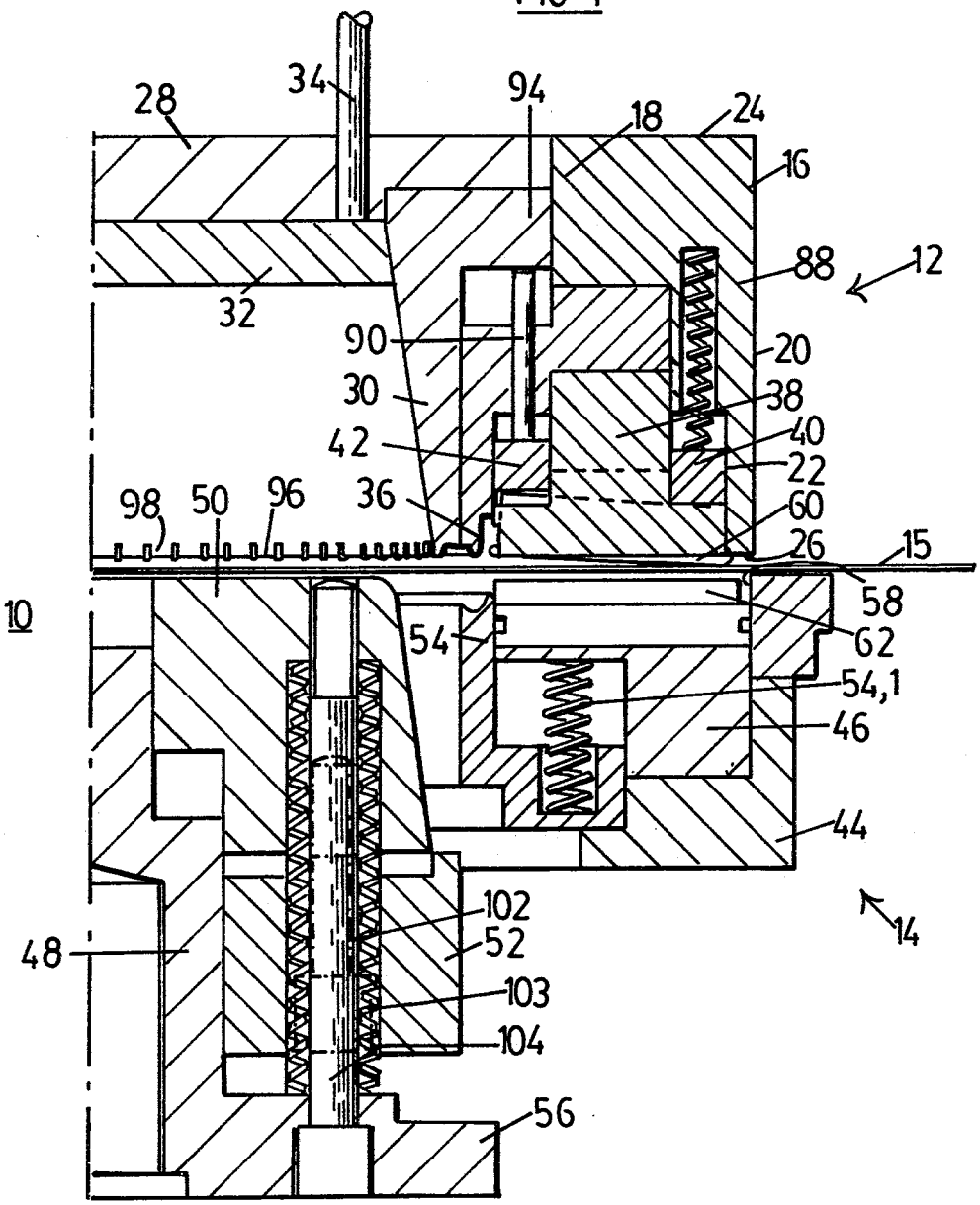
FIG. 1 is an axial cross sectional half elevation of apparatus in accordance with the preferred embodiment of the invention.
Figure 2:
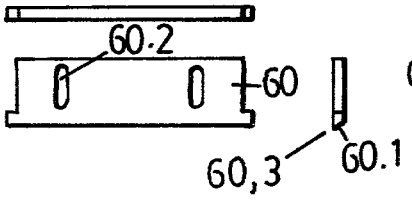
FIG. 2 is a plan, front elevation and end elevation of one of the upper slats in the apparatus shown in FIG. 1.
Figure 3:
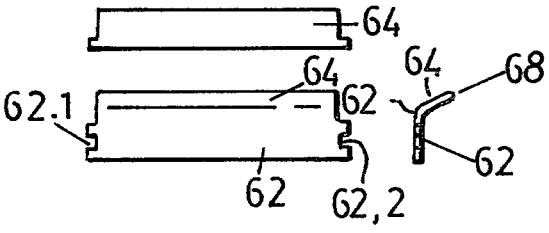
FIG. 3 is a plan, front elevation and end elevation of one of the lower slats used in the apparatus shown in FIG. 1.

Referring to the drawings and in particular to FIGS. 1 to 5 of the drawings, an apparatus for punching metal foil containers, in accordance with the invention, is generally indicated by the numeral 10. The apparatus 10 includes two main parts namely an upper part 12 and a lower part 14.

The upper part 12 includes an annular main body 16, having three parts 18, 20 and 22 increasing in diameter from the top side 24 to the lower end 26 of the main body. Within the part 18 of the main body 16 there are slidably fitted a cover plate 28 and a female die 30 that defines the cup shape of a container to be formed. Below the cover plate 28 and within the female die 30 there is an ejector disc 32 operable by means of rods 34 projecting through the cover plate 28.

There is further secured within the main body 16 an ironing and curling ring 36 and an upper slat holder 38. The slat holder 38 is provided with an outer push ring 40 and an inner push ring 42.

The lower part 14 of the apparatus 10 includes a fixed annular base 44 with a lower slat holder 46 secured therein. A punch 50, that defines the cup shape of a container to be formed, and a shoulder ring 52 are assembled on a core 48. The punch 50 is of complementary shape to the female die 30. Lower curling ring 54 is resiliently mounted in the body 44 so that it may be pushed up by the core flange 56 against springs 54,1. The punch assembly parts 50, 52 and 56 are held together by bolts 104 and springs 103 keep parts 50 and 56 resiliently apart. Part 52 hangs slideably from bolts 102, (shown in broken lines), which are screwed into punch 50. The upper slat holder 38 holds upper slats 60, which are shown in particular also in FIGS. 2 and 5. Slats 60 have inclined lower faces 60,1 and are slidable in slots in slot holder 38, the amount of sliding limited by slotted holes 60,2 through which wire is threaded. The lower slat holder 46 holds lower slats 62, which are shown in particular also in FIGS. 3 and 4. Slats 62 each present an inclined face 64, (which is wider than inclined face 60,1 of the upper slats), and an undercut 66. Slats 62 are held in slots in slat holder 46 which slots are wider than the material of the slat to allow a leaf spring to be inserted with the slat in the slot to impart resiliency to the mounting of the slats 62. Edge 68 of each slat 62 is radially aligned and edge 60,3 of each slat 60 is radially aligned. The inclination of face 64 is about 15° and of face 60,1 about 20°. Slats 62 are kept in place by wires which engage notches 62,1 and 62,2.

Female die 30 has a drawing edge 96 which has a plurality of scoring formations 98.

Further particulars and the co-operation of the parts above-described are explained later on when describing the working of the apparatus 10.

In use, the upper part 12 is initially located well above the lower part 14, (to allow ejection of the previously formed container in a repetitive operation). A sheet of foil 15 (usually a continuous strip taken from a roll), is fed in between the parts 12 and 14. The upper part 12 is moved down and FIG. 1 shows the parts momentarily before the blank 15 is cut as a result of further lowering of the upper part 12, the outer periphery of this part serving as a male cutter that fits into the recess 58 serving as the female cutter part.

The upper part 12 and lower part 14 then stop and remain at positions which provide a clearance between the face of the upper slat holder 38 and the highest parts of the lower slats 62 so that the foil is not held between these parts, and only just sufficiently close for the upper and lower slats to lightly indent the foil blank as shown in FIG. 6. The blank is not clamped or held at all between the face of the upper slat holder 38 and the lower slats 62 at any part of the forming process (the spacing can be seen in FIG. 9). The lengths of the slats 60 and 62 may vary according to requirements and are approximately equal to the depth of the cup of a container to be formed. Push ring 42 is located by rods 90 when they bear against female die 30 so that the inner ends of slats 60 are about 0.5 mm raised above the surface of holder 38. Outer push ring 40 is lightly pressed downwards by light springs 88, but contact with the foil lifts the outer ends of the slats 60 causing only a light indentation in the foil.

Once the upper and lower parts have taken up the positions described above the punch moves into the female die, drawing a cup shape. The deformation from a flat form into a cup is effected by the blank turning about the drawing edge 96 of the female die 30 and the scoring formations 98 on the edge 96 from the beginning of the draw, ensure uniform creasing of the blank 15 in the initially formed parts of the wall near the container base. The foil remaining in the flat area between the slats is drawn progressively into the walls of the cup, and excess material is guided by the slats into regular double fold pleats. The score marks 108 run into the double fold pleats and promote the initial formation of the pleats. An early stage in the drawing of the cup shape is shown in FIG. 7, showing score lines 108. A further (intermediate) stage is shown in FIG. 8, showing score lines 108 running into pleats 92.

The blank makes contact with the ironing ring 36 and the edge 96 of the female die 30. Both the ring 36 and edge 96 have a rounded edge of small thickness. In FIGS. 7 and 8 the turnover position of the foil from the flat area into the cup walls is at 111, the edge of the base of the cup being formed is at 106. The ironing ring 36 acts at 110 (FIG. 8) to flatten the pleats from, for example, the shape shown in FIG. 10 to the shape shown in A—A of FIG. 13. This provides the important feature of flattening the pleats before the turnover. During forming of the pleats on the flat the foil is lightly guided mainly through line contacts with edges 60,3 and 68. When we use the words flat in this specification we mean the generally flat area even although it has pleats formed in it or in the process of being formed.

When the full depth of the cup 105 is reached the core 48 still continues to move and punch 50 begins to displace the female die 30, cover plate 28 and ejector disc 32 upwardly against a downward spring load. When the female die 30 slides upwards the shoulders 94 of the die also move up, thereby releasing the push pins 90 and hence the push ring 42. The inner section of the slats 60, are thereby released while the outer parts of the slats 60 no longer affect the flat part of the blank 15.

Figure 11:
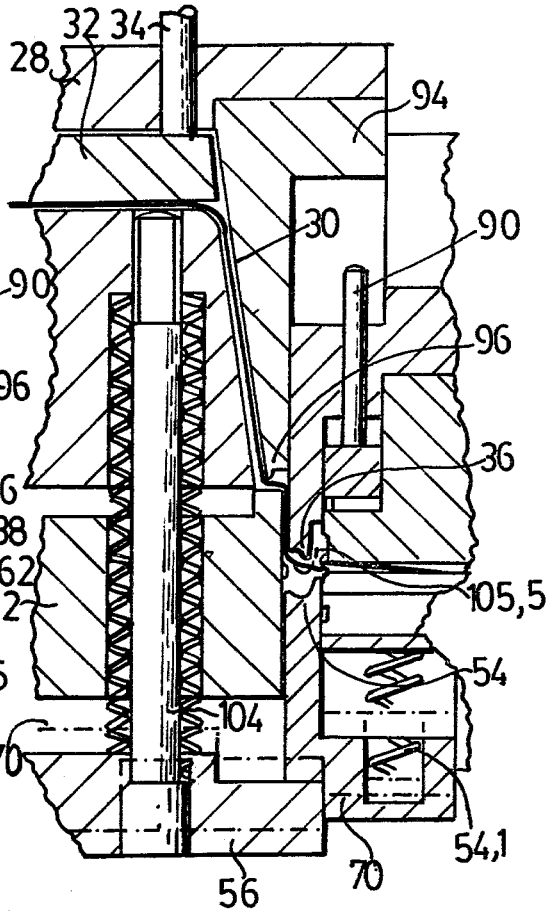
FIG. 11 is an axial cross sectional elevation in part of the apparatus shown in FIG. 1, shown in a position reached after drawing a cup and wiping down; the broken lines show a further position reached when the first of two curl forming steps is reached.

This leads to a position as shown in FIG. 11, with the cup drawn as shown. At this position plate 28 comes up against a stop, (not shown). Core flange 56 continues to move up and, engaging the curling ring 54, moves it up to position shown by broken lines 70 in FIG. 11 to act on the edge of the cup and form a first part 105,5 of the curl.

Since during this movement punch 50 is stationary against the stopped plate 32, the punch assembly compresses against the resilient action of the springs 103. The punch 50 has sufficient clearance from the female die 30 for the walls 105,2 of the cup not to touch the female die walls 30, to give an unmarked outer surface of the walls 105,2.

Figure 12:
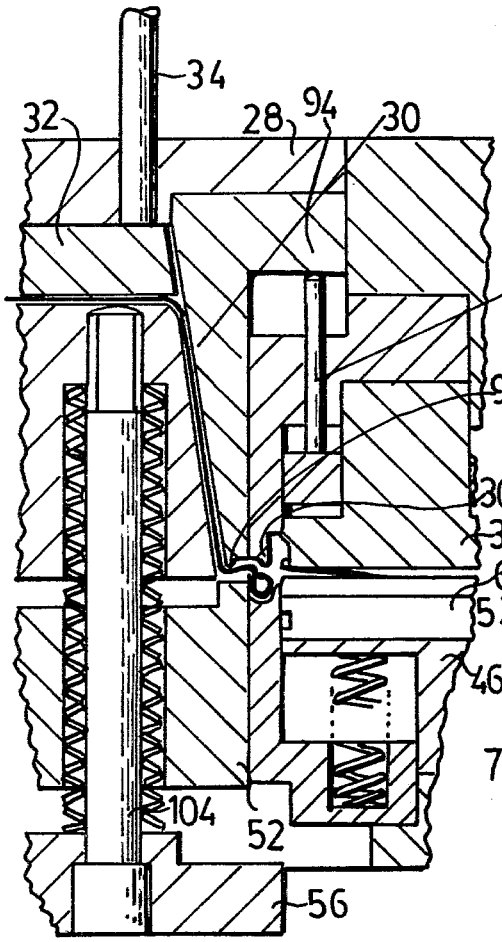
FIG. 12 is an axial cross sectional elevation in part of the apparatus shown in FIG. 1, shown in a position reached after the second of the two curl forming step has been completed.

This completes the upward travel of the core 48 which then retracts, the punch 50 and female die 30 follow, bringing down the half curled edge 105,5 into contact again with the curling ring 54, which completes the curl. This is shown in FIG. 12.

The die parts 12 and 14 then separate and the container is ejected by a downward movement of the ejector plate 32.

Since the pleats are neatly formed and are flat when they are drawn over the drawing edge 96 into the container wall, the stressing of the foil at the drawing edge is minimized.

The apparatus of this example can produce containers from aluminium foil of notable hardness of about 0.05 mm, or foil between 0.025 and 0.2 mm approximately. Double layer foil containers can also be produced which may achieve a greater total thickness than 0.2 mm. Coated foils cam also be formed.

Figure 13:
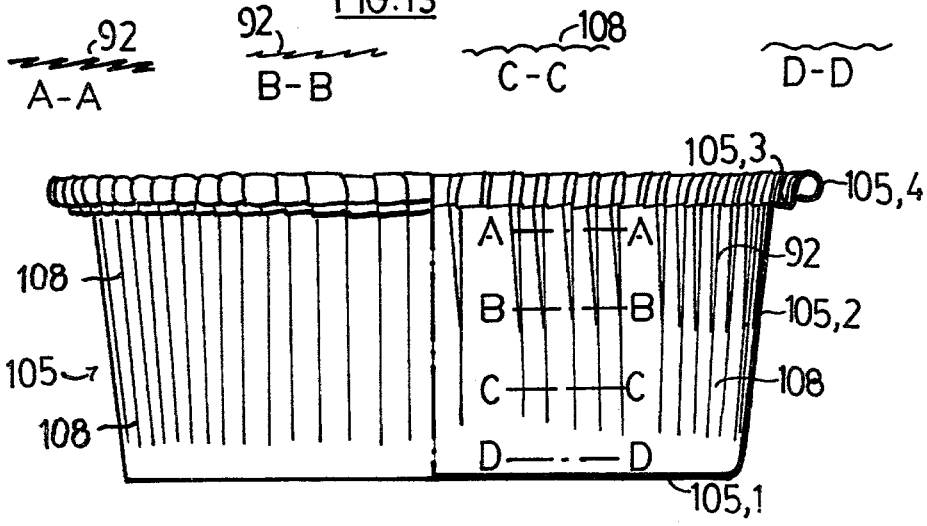
FIG. 13 is an elevation, half in section, of a foil container in accordance with the preferred embodiment of the invention, with partial sectional plan views of the wall at sections A—A, B—B, C—C and D—D.

The container 105 shown in FIG. 13 has a base 105,1 and walls 105,2 and at its rim a ledge 105,3 for seating a lid, and a curl 105,4 for strength and a neat finish. As can be seen the double fold pleats 92 in the wall are longitudinally aligned and are well developed near the top of the wall, (section A—A). If a deeper container is drawn the pleats become neater and lend even more reinforcement to the walls and rim. Lower down, (section B—B) the pleats 92 are much reduced, since there is less excess material to accommodate in the circumferential direction at that position. At section C—C, there are no double fold pleats, but longitudinal score marks 108, which are aligned with pleats 92, maintain a good appearance. Close to the base 105,1 there are no score marks but the material has a wavy form section D—D) which is regular, due to the influence of the regular score marks.

Whereas the term "foil" would normally be intended to mean material, up to approximately 0.2 mm, this invention can in principle be applied to thicker material, for example where relatively large containers are being made, and the term shall be interpreted in this specification accordingly.

As will be appreciated from the above the double fold pleat technique of this invention is applicable to radiused corners of angularly shaped containers.

I claim:

1. A method of manufacturing containers from flat foil which comprises a sequence of steps including providing a flat foil blank, indenting the blank with alternate upwardly and downwardly directed indentations which extend in radial directions, initially drawing a shape which has a base and a first portion of the walls in the center of the blank and which initially leaves a remaining flat area of the blank around said base and said first portion of the walls during the drawing, lightly guiding the remaining flat area of the indented blak, which is being drawn into the walls so as to fold the flat area into regular double fold pleats, and flattening the double fold pleats before they move from the flat area of the blank into an area in which they form the final portion of the walls.

2. A method as claimed in claim 1, in which, in addition to the light guiding of the blank in the flat area during forming, the blank is scored in positions aligned with the indentations.

3. A method as claimed in claim 1, in which the walls are drawn over a punch and are maintained out of contact with a female die which provides a cavity in the die parts into which the punch moves.

4. A method as claimed in claim 1, in which the remaining flat area of the blank is lightly guided during drawing, by contacting the blank mainly along radial lines of contact located alternately above and below the foil.

5. An apparatus for manufacturing foil containers which comprises a punch for drawing a shape having a base and walls in a flat foil blank, an upper peripheral guide structure and a lower peripheral guide structure located around the punch, each peripheral guide presenting a plurality of generally radially aligned ridge formations, the ridge formations of the upper guide complementarily interacting with the ridge formations of the lower guide for forming alternate upwardly and downwardly directed light indentations in the flat blank into regular double fold pleats, and a drawing edge located intermediate of the upper peripheral guide structure and the lower peripheral guide structure and the punch for flattening the regular double fold pleats when the foil is drawn over the drawing edge by the punch.

6. An apparatus as claimed in claim 5, in which the ridge formations in the upper guide are flat upper slats slidably located in slots in an upper slat holder.

7. An apparatus as claimed in claim 5, in which the ridge formations in the lower guide are lower slats located in a lower salt holder, the lower slat having an undercut on one side.

8. An apparatus as claimed in claim 7, in which the lower slats in the lower slat holder are resiliently fixed in the lower slat holder.

9. An apparatus as claimed in claim 7, in which the surfaces in the lower slats which face the upper slats and the surfaces in the upper slats which face the lower slats are inclined.

10. Apparatus as claimed in claim 5 further comprising a female die into which said punch draws said shape, and means for flattening said regular double fold pleats before they move into said female die for the formation of the walls of said containers.

11. An apparatus for manufacturing containers from flat foil which comprises means for providing a flat foil blank, means for indenting the blank with alternate upwardly and downwardly directed indentations which extend in radial directions, means for initially drawing a shape which has a base and a first portion of the walls formed from the center of the blank, and which initially leaves a remaining flat area of the blank around said base and said first portion of the walls, means for lightly guiding the remaining flat area of the indented blank while it is being drawn into the walls during the drawing operation, so as to fold the flat area into regular double-fold pleats, and means for flattening the double-fold pleats before they move from the flat area of the blank into an area in which they form the final portion of the walls.

12. An apparatus according to claim 11, said means for drawing comprising punch means and female die means, and stop means for maintaining said walls out of contact with said female die means during drawing.

13. An apparatus for manufacturing foil containers which comprises a punch for drawing a shape having a base and walls in a flat foil blank, an upper peripheral guide structure and a lower peripheral guide structure located around the punch, each peripheral guide presenting a plurality of generally radially aligned ridge formations, the ridge formations of the upper guide complementarily interacting with the ridge formations of the lower guide for forming alternate upwardly and downwardly directed light indentations in the flat blank into regular double fold pleats, a drawing edge located intermediate of the upper peripheral guide structure and the lower peripheral guide structure and the punch for flattening the regular double fold pleats when the foil is drawn over the drawing edge by the punch, and a plurality of scoring formations located along the drawing edge, in positions of radial correspondence with the ridge formations which form the indentations in the foil.

14. An apparatus as claimed in claim 13, in which the ridge formations in the upper guide are flat upper slats slidably located in slots in an upper slat holder.

15. An apparatus as claimed in claim 13, in which the ridge formations in the lower guide are lower slats located in a lower slat holder, the lower slat having an undercut on on side.

16. An apparatus as claimed in claim 15, in which the lower slats in the lower slat holder are resiliently fixed in the lower slat holder.

17. An apparatus as claimed in claim 15, in which the surfaces in the lower slats which face the upper slats and the surfaces in the upper slats which face the lower slats are inclined.

18. Apparatus as claimed in claim 13 further comprising a female die into which said punch draws said shape, and means for flattening said regular double fold pleats before they move into said female die for the formation of the walls of said containers.

* * * * *

UNITED STATES PATENT AND TRADEMARK OFFICE

CERTIFICATE OF CORRECTION

PATENT NO. : 4,212,184

DATED : July 15, 1980

INVENTOR(S) : Hans Falch et al

It is certified that error appears in the above–identified patent and that said Letters Patent are hereby corrected as shown below:

Column 6, line 47: reads "guiding the remaining flat area of the indented blak"
should read -- guiding the remaining flat area of the indented blank --.

Column 8, line 32: reads "undercut on on side"
should read -- undercut on one side --.

Signed and Sealed this

*Twenty-eighth* Day of *October 1980*

[SEAL]

*Attest:*

SIDNEY A. DIAMOND

*Attesting Officer*

*Commissioner of Patents and Trademarks*